US005090371A

United States Patent [19]

Schäpertöns et al.

[11] Patent Number: 5,090,371

[45] Date of Patent: Feb. 25, 1992

[54] EVAPORATIVE COOLING SYSTEM

[75] Inventors: Herbert Schäpertöns, Gifhorn; Bodo Scheibner, Wolfsburg, both of Fed. Rep. of Germany

[73] Assignee: Volkswagen AG, Fed. Rep. of Germany

[21] Appl. No.: 704,797

[22] Filed: May 23, 1991

[30] Foreign Application Priority Data

May 25, 1990 [DE] Fed. Rep. of Germany ..... 4016762

[51] Int. Cl.[5] ..... F01P 9/02

[52] U.S. Cl. ..... 123/41.21; 123/41.46; 60/618

[58] Field of Search ..... 123/41.2, 41.21, 41.24, 123/41.46; 60/618

[56] References Cited

U.S. PATENT DOCUMENTS 4,300,353 11/1981 Ridgway ..... 60/618

FOREIGN PATENT DOCUMENTS 2413105 10/1975 Fed. Rep. of Germany .

2639187 3/1978 Fed. Rep. of Germany .

62-258108 11/1987 Japan ..... 60/618

*Primary Examiner*—Noah P. Kamen

*Attorney, Agent, or Firm*—Brumbaugh, Graves, Donohue & Raymond

[57] ABSTRACT

The representative evaporative cooling system disclosed in the specification includes a cooling pump in a condensate line leading from a condenser to an internal combustion engine and a fan associated with the condenser, and has a turbine disposed in the coolant vapor line leading from the engine to the condenser which utilizes the energy of the coolant vapor to drive the coolant pump and the fan.

3 Claims, 1 Drawing Sheet

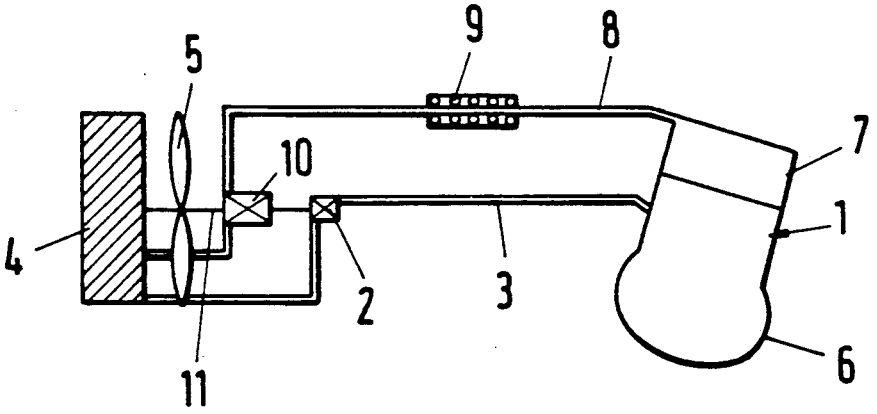
9
8
5
7
10
1
4
2
3
6
11

EVAPORATIVE COOLING SYSTEM

BACKGROUND OF THE INVENTION

This invention relates to cooling systems in which a coolant is evaporated in a machine to be cooled, such as an internal combustion engine, and coolant vapor is condensed in a condenser for recirculation.

Evaporative cooling systems, particularly those used in connection with internal combustion engines of motor vehicles, are well known in the art and are described in published patent literature so that it is not necessary to describe such systems in detail.

Such evaporative cooling systems include electrically operated coolant system devices such as an electrically operated coolant pump which is normally provided to circulate coolant and an electrically operated fan which is often included to cool the condenser. Consequently, such coolant systems impose a load on the storage battery used in a motor vehicle, for example.

SUMMARY OF THE INVENTION

Accordingly, it is an object of the present invention to provide an evaporative cooling system which overcomes the disadvantages of the prior art.

Another object of the invention is to provide an evaporative cooling system having a coolant pump and a fan which is capable of operating without using external energy for those devices.

These and other objects of the invention are attained by providing an evaporative cooling system in which energy from vaporized coolant is used to drive one or more coolant system devices.

A particular advantage of the coolant system of the invention results from the fact that there is a proportional relation between the amount of coolant vapor flowing through the vapor line and the driving power required for coolant system devices such as a coolant pump and a fan. In this way, it is possible in accordance with the invention to provide the driving power required for a coolant pump and a fan, for example, by using the energy of the coolant vapor which changes in relation to the required driving power.

Where an internal combustion engine is to be cooled by the cooling system, it is possible to use an exhaust gas heat exchanger to superheat the coolant vapor to improve the efficiency of the arrangement for extracting energy from vaporized coolant, such as a turbine. It is also possible to increase the power made available to the arrangement for extracting energy from the vapor, such as a turbine, by an appropriate choice of the coolant. For example, a coolant having a lower boiling point than the usual glycol-water mixture may be used.

With respect to the prior art cooling systems, it will be noted that German Offenlegungsschrift No. 24 13 105 discloses the utilization of energy contained in the coolant vapor, which is increased by the use of a heat exchanger, by providing a vapor turbine in which the expansion of the vapor takes place. In that case, however, the vapor turbine returns the kinetic energy obtained in this way to the internal combustion engine. Similarly, German Offenlegungsschrift No. 26 39 187 discloses a cooling system wherein a conventional coolant is superheated by the exhaust gas from the engine and is subsequently expanded in a turbine which drives a compressor for compressing the coolant.

On the other hand, the cooling system of the present invention provides driving energy for a circulating pump in the cooling system and/or a fan associated with a cooling system condenser.

BRIEF DESCRIPTION OF THE DRAWING

Further objects and advantages of the invention will be apparent from a reading of the following description in conjunction with the accompanying drawing which illustrates schematically a representative evaporative cooling system arranged in accordance with the invention for use in cooling an internal combustion engine.

DESCRIPTION OF PREFERRED EMBODIMENT

In the accompanying drawing showing a typical embodiment of the invention, an internal combustion engine utilizing evaporative cooling is schematically illustrated. Since evaporative cooling arrangements in internal combustion engines are well known, the details of the engine cooling arrangement are not shown. The cooling system includes a coolant circuit with a coolant pump 2 for circulating liquid coolant through a condensate line 3 from a condenser 4, cooled by a fan 5, where coolant has been condensed from the vapor stage. From the line 3, the coolant flows through cooling chambers and conduits (not shown) in the engine block 6 of the engine 1. From there, the coolant, which is at least partially evaporated by engine heat, rises into a cylinder head 7 of the engine and leaves the head through a vapor line 8.

An exhaust gas heat exchanger 9 is associated with the vapor line 8 so that the exhaust gas from the internal combustion engine flowing through the heat exchanger heats the vapor in the vapor line 8 to generate superheated steam. Following the heat exchanger 9 in the direction of flow of the coolant vapor through the line 8 is a turbine 10 which is driven by the flow of superheated coolant vapor. The turbine 10 is mechanically linked by a shaft 11 to both the coolant circulating pump 2 and the fan 5 which are therefore driven by the flow of superheated vapor.

Accordingly, by the cooling system of the invention, evaporative cooling is provided and the energy from the coolant vapor is used to drive coolant system devices such as a coolant pump and/or a fan associated with the coolant system condenser.

Although the invention has been described herein with reference to a specific embodiment, many modifications and variations therein will readily occur to those skilled in the art. Accordingly, all such variations and modifications are included within the intended scope of the invention.

We claim:

1. An evaporative cooling system for an internal combustion engine comprising an engine coolant circuit including a condensate line, a coolant circulating pump, a condenser for condensing vaporized engine coolant having an associated cooling fan, a coolant vapor line leading to the condenser, and coolant vapor energy extraction means for utilizing energy from engine coolant vapor in the vapor line including a driveshaft extending in opposite directions from the extraction means for driving the coolant circulating pump and the condenser fan.

2. An evaporative cooling system in accordance with claim 1 wherein the coolant vapor energy extraction means comprises a drive turbine disposed in the coolant vapor line which is drivingly connected at opposite ends to the coolant circulating pump and the condenser fan, respectively.

3. An evaporative cooling system in accordance with claim 1 including a heat exchanger associated with the vapor line and arranged to receive the exhaust gas of an internal combustion engine to the cooled by the cooling system.

* * * * *